United States Patent [19]

Hughes et al.

[11] 4,211,343

[45] Jul. 8, 1980

[54] BULK DRY FOOD PRODUCT STORAGE, DISPLAY AND DISPENSING APPARATUS

[76] Inventors: Peter I. Hughes, 2501 Spring St., Redwood City, Calif. 94063; Robert J. Lynch, P.O. Box 1191, Santa Cruz, Calif. 95060; James J. Ahrens, 26081 Mocine Ave., Hayward, Calif. 94544

[21] Appl. No.: 907,547

[22] Filed: May 19, 1978

[51] Int. Cl.[2] ..... G01F 11/10

[52] U.S. Cl. ..... 222/130; 222/135; 222/154; 222/356; 222/564

[58] Field of Search ..... 220/855 P, 1 R; 222/356, 357, 358, 566–574, 130, 135, 154, 564; 366/165; 119/53

[56] References Cited

U.S. PATENT DOCUMENTS

| | | | |
|---|---|---|---|
| 1,218,092 | 3/1917 | Larsen | 222/356 |
| 3,208,732 | 9/1965 | Ranson | 220/1 R |
| 4,006,850 | 2/1977 | Farina | 222/569 |

*Primary Examiner*—Allen N. Knowles
*Attorney, Agent, or Firm*—Warren M. Becker

[57] ABSTRACT

A bulk dry food product storage, display and dispensing apparatus is described. In the apparatus there is provided a plurality of modules. In each of the modules there is provided a plurality of hoppers. Each hopper comprises a pair of side wall members and a curved bottom member. The curved bottom member comprises a front portion and a rear portion. The front and the rear portions each comprise a continuously changing radius of curvature, the continuously changing radius of curvature on the front portion being different from the continuously changing radius of curvature on the rear portion such that fresh product being added to the hopper from the rear thereof by being dumped on the rear portion of the curved bottom, slides down the rear portion, moves existing product forwardly and upwardly and displaces the existing product being supported on the front portion, causing it to fall on top of the fresh product moving therebeneath. Extending from the front lip of the curved bottom, there is provided a spout through which product is moved by means of a rake member for removing the product from the hopper. In the spout there is provided a movable flap member for opening and closing the spout. On at least one side of the apparatus there is mounted a bag dispenser for dispensing plastic product bags and a cannister for holding ties for tying the bags.

19 Claims, 6 Drawing Figures

BULK DRY FOOD PRODUCT STORAGE, DISPLAY AND DISPENSING APPARATUS

BACKGROUND OF THE INVENTION

The present invention relates to food product storage, display and dispensing apparatus in general and in particular to a bulk dry food product storage, display and dispensing apparatus.

The type of food stored, displayed and and dispensed using apparatus according to the present invention includes such foods as rice, beans, seeds, corn and the like. With respect to each of the products mentioned, there may be various varieties of the products. For example, within the category of beans there may be kidney beans, lima beans, pink beans, soy beans, etc.

Heretofore, various means have been employed for dispensing dry food products. For example, one of the methods used for dispensing dry food products is to dispense them directly from the container in which they are transported to the store or other distribution point. If the container is a cloth or paper bag or the like, it is generally seated on the floor and propped against a wall or the like or otherwise supported to prevent its falling over as the product is removed therefrom. To remove the product from the bag, the top is opened and folded back exposing the product. A scoop, cup or similar utensil is used for removing the product from the bag. Barrels are also used for dispensing bulk dry food products. When barrels are used, the top of the barrel is removed and a scoop, cup or similar utensil is used for removing product from the barrel. When it is desired to display a volume of product which is typically less than the volume employed in a conventional shipping container, the product is removed from the shipping container, typically either a bag or a barrel, and is placed in a hopper. The hopper may or may not have a covering member for covering the hopper between usages. When a hopper is used, it may be used separately or in combination with other hoppers for dispensing a variety of dry food products.

Dry food products of the type described above intended for human consumption should typically be free of foreign matter and the like which may contaminate the product. When open bags, barrels and hoppers are employed for dispensing dry food products, the opportunity for contamination of the products is greatest, particularly if the bag, barrel or hopper is left uncovered between usages. When conventional covered hoppers and the like are used, the opportunity for contamination of the product stored therein is reduced. However, it may be noted that the hopper is opened not only when fresh product is added but also each time a customer makes a selection. Thus, although the opportunity for contamination is reduced, it is still significant.

While airborne contamination such as dust, insect matter and the like is a principal concern to those selling dry food products using bags, barrels and conventional hoppers, the use of open bags, barrels and hoppers also provides an opportunity for contamination by the user thereof. For example, a user may contaminate a product by touching the product with the hands when scooping it from the container, as well as by breathing on the product.

Another consideration in the storage and dispensing of dry food products is that the food product being dispensed should always be as fresh as possible. When the product is dispensed from a shipping bag or container, there is, of course, no problem associated with adding products to the bag or container. However, when adding fresh product to a conventional hopper, there is a problem associated with adding the product in that no means is generally available for placing fresh product beneath the existing product. As a consequence, fresh product is usually simply dumped on top of existing product. In time, the existing product becomes quite old and stale. Heretofore, one of the methods used to minimize this problem was to mix the existing product with the fresh product. However, this is not a particularly satisfactory method of handling the problem.

SUMMARY OF THE INVENTION

In view of the foregoing, a principal object of the present invention is a bulk dry food product storage, display and dispensing apparatus comprising a plurality of modules which are stacked in vertical relationship on a base member. In each of the modules there is provided a plurality of covered hoppers. Each of the covered hoppers has, extending from the front thereof, a spout and a rake having an elongated handle extending through a hole provided therefor in a forward wall of the hopper for raking product from the hopper through the spout. Forming each of the hoppers is a pair of side walls and a curved bottom. The curved bottom comprises a front portion and a rear portion. The front and rear portion each comprise a continuously changing radius of curvature. The continuously changing radius of curvature of the front portion is different from the continuously changing radius of curvature of the rear portion whereby fresh product being added to the hopper from the rear thereof by being dumped on the rear portion of the curved bottom slides down the rear portion, moves existing product forwardly and displaces existing product being supported on the front portion, causing the displaced product to move upwardly and fall on top of the fresh product moving therebeneath.

Preferably, each of the hoppers is made of a transparent material for providing a visual display of a product stored therein from all sides. The continuously changing radius of curvature of the front portion of the curved bottom is generally larger than the continuously changing radius of curvature of the rear portion. The base member, while provided for supporting the plurality of modules is also provided for supporting pre-packaged products in a space provided therefor beneath the hoppers. The only access to the interior of the hoppers for adding fresh product is a movable cover located at the rear of the hoppers which is provided only for access by the operators of the hoppers.

A principal advantage of the dispensing apparatus according to the present invention is that bulk dry food product is displayed and dispensed with little chance for contamination by airborne contaminants or from members of the general public because it is wholly enclosed and the general public does not have access to the interior of the hoppers.

Another advantage of the apparatus according to the present invention is the esthetic advantage achieved through the display of natural food products by means of the use of transparent materials.

BRIEF DESCRIPTION OF THE DRAWINGS

The above and other objects, features and advantages of the present invention will become apparent from the following detailed description of the accompanying drawings in which.

DETAILED DESCRIPTION OF THE DRAWINGS

Figure 1:
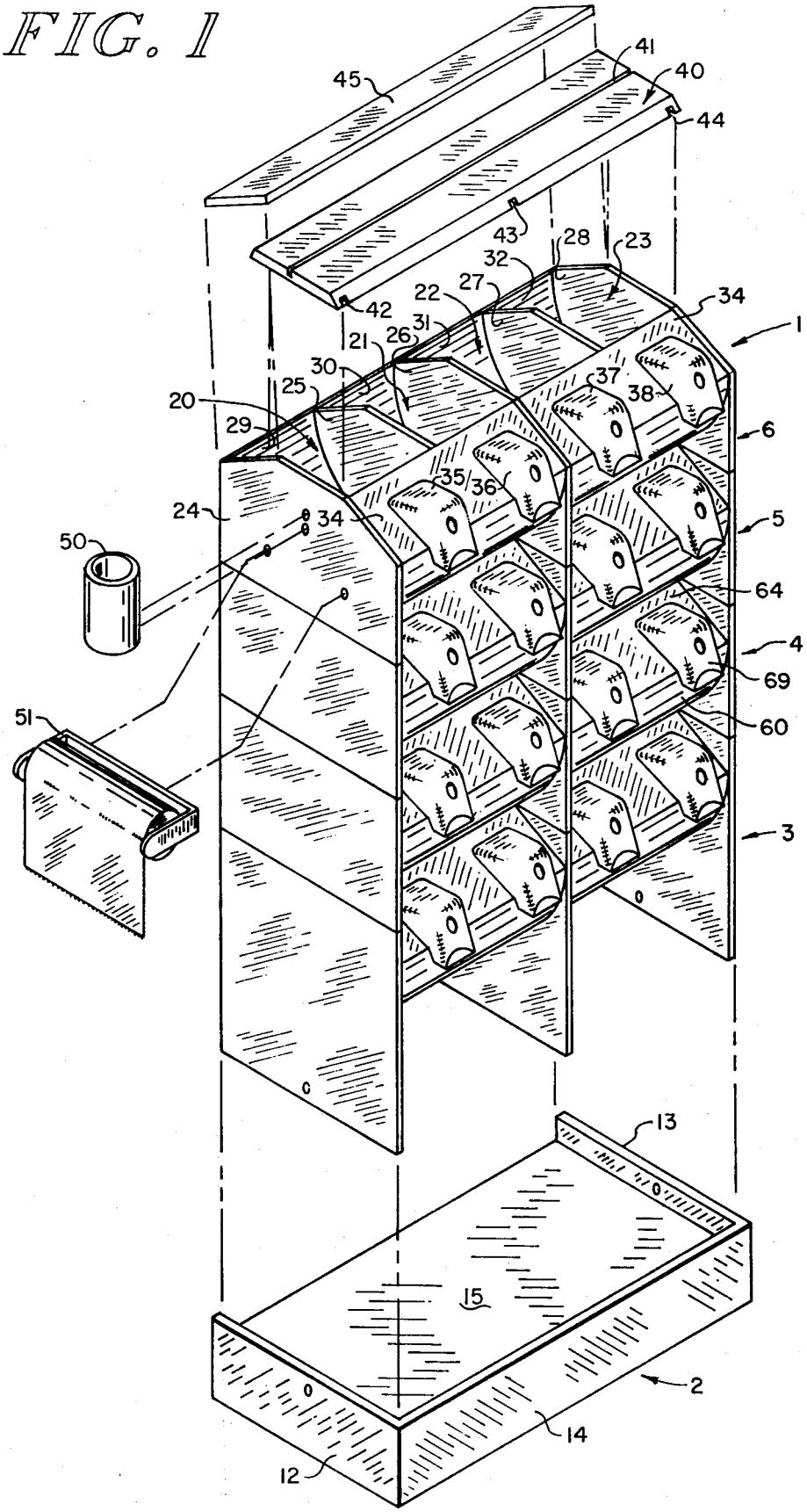
FIG. 1 is a partially exploded isometric view of a preferred embodiment of the present invention.

Referring to FIG. 1, there is provided in accordance with the present invention a bulk dry food product storage, display and dispensing apparatus designated generally as 1. In apparatus 1 there is provided a base member 2 and a plurality of modules 3, 4, 5 and 6.

In the base member 2 there is provided a pair of side members 12 and 13 and a front member 14. Extending between and perpendicular to the side members 12 and 13 and interior of the members 12, 13 and 14, there is provided a base or floor member 15. In a typical embodiment the floor member 15 is coated with a vinyl coating. The members 12, 13 and 14 comprise redwood boards. The members 12 and 13 are approximately 20¼ inches long, ¾ inches thick and 7¼ inches wide. The member 14 is approximately 37 inches long, ¾ inches thick and 7¼ inches wide. The floor member 15 is supported interior of the board members 12, 13 and 14, approximately 2 inches from the top of the board members. Typically, it comprises ¾ inch particle board.

The modules 4 and 5 are identical and the modules 3 and 6 are substantially identical to modules 4 and 5. Their differences lie in the size and shape of their side and interior wall members, depending upon their location in the vertical stack in which they are arranged, as will become apparent below.

As shown in FIG. 1, each of the modules comprises a plurality of substantially identical hoppers. In module 6, for example, there is provided a plurality of hoppers 20, 21, 22 and 23. The hoppers 20–23 are formed by a plurality of side and interior wall members 24, 25, 26, 27 and 28 and a plurality of curved bottom members 29, 30, 31 and 32.

Extending from a sloping wall 34 at the front of the hoppers 20–23 there is provided a plurality of spouts 35, 36, 37 and 38, as will be described more fully below. Fitted to the top of the module 6, there is provided a display board 40. Board 40 is provided with a centrally located slot 41. The slot 41 is provided for inserting cardboard display boards and the like for displaying the contents of the hoppers or the like. On the under side of the board there is provided a plurality of parallel slots 42, 43 and 44 for receiving the top of the wall members 24, 26 and 28 which extend slightly above the top of the wall members 25 and 27. At the rear of the hoppers 20–23 there is provided a cover member 45. Cover member 45 is provided for covering the rear of the hoppers 20–23 and is removable therefrom for filling the hoppers.

Except for the side and center wall members, the modules 3, 4, 5 and 6, as previously indicated, are identical. The side and interior wall members of module 3 are substantially square and approximately 20 inches on each side. These dimensions provide a space between the lower surface of the hoppers in the module 3 and the floor 15 of the base member 2 for the storage of prepackaged products such as, for example, five and ten-pound bags of rice and the like. The side and center wall member of modules 4 and 5 are identical. They are rectangular and are approximately 12 inches high and 20 inches wide. The side and center wall members of module 6 are substantially identical in size to the modules 4 and 5. However, a portion of their top front and top rear edges are cut at an angle relative to the face thereof for receiving the cover 45 and for providing an esthetic and uniform appearance with respect to the sloping wall 34 of the module 6 from which the spouts 35, 36, 37 and 38 extend.

Extending from the wall surface 24, there is provided a canister 50 for containing ties. Below the canister 50 there is mounted to the wall member 24 a roller assembly 51 for supporting a roll of plastic bags. The plastic bags are provided for containing product removed from the hopper. The ties are provided for tying the bags closed.

Because each of the hoppers of the modules 3–6 are substantially identical in size and shape, only one of them needs to be described in detail.

Figure 2:
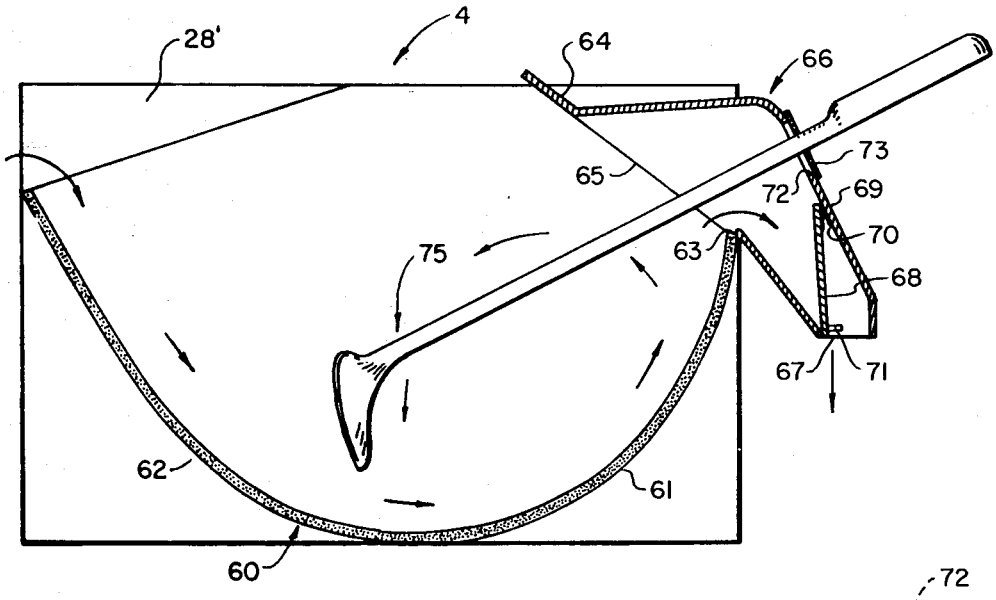
FIG. 2 is a cross-sectional view of one of the hoppers of FIG. 1.
Figure 2A:
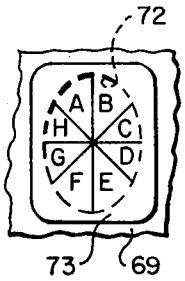
FIG. 2A is a partial plan view of the rake handle receiving hole of FIG. 2.

Referring to FIGS. 2 and 2A showing a cross section of the rightmost hopper of the module 4, there is provided a rectangular end wall member 28'. Extending perpendicularly from the wall member 28', there is provided a curved bottom member 60. The curved bottom member 60 is identical in size and shape to each of the bottom members 29, 30, 31 and 32 described above with respect to the hoppers 20–23 of the module 6 as well as all of the other hoppers in the apparatus.

As seen in FIG. 2, the curved bottom 60 comprises a front portion 61 and a rear portion 62 extending fore and aft of a midline extending approximately through the center of the hopper. As will be described in more detail with respect to FIG. 5, the front and rear portions 61 and 62 each comprise a continuously changing radius of curvature with the continuously changing radius of curvature of the front portion being different from the continuously changing radius of curvature of the rear portion whereby fresh product being added to the hopper from the rear thereof by being dumped on the rear portion 62 of the curved bottom 60, slides down the rear portion, moves existing product forwardly and displaces existing product being supported on the front portion 61, causing the displaced product to move upwardly and fall on top of the fresh product moving therebeneath. In practice, the continuously changing radius of curvature of the front portion is generally larger than the continuously changing radius of curvature of the rear portion.

Extending upwardly at an angle from an upper forward lip 63 of the curved bottom 60, there is provided a sloping forward wall surface 64, which is identical to the wall surface 34 described above with respect to module 6, for covering the upper forward part of the hopper. Extending from a portion of the lip 63 and the edges of a hole 65 in the wall 64, there is provided an outwardly and downwardly extending tubular member forming a spout 66, which is identical to the spouts 35–38 of the module 6 as well as all of the other spouts in the apparatus.

At the lower exterior end of the spout 66, there is provided a discharge port 67. Interior of the discharge port 67, there is provided a movable flap member 68. The movable flap member 68 is movably attached to a wall 69 of the spout 66, as by a hinge member 70. At the lower end of the flap member 68, there is provided a pin 71. The pin 71 is provided for limiting the extent to which the flap member is free to pivot toward the wall member 69 so that the flap member 68 does not become jammed in an open position.

Above the flap member 68, there is provided in the wall 69 a rake handle receiving hole 72 for receiving a handle 75 of a rake 76. Overlying the hole 72 there is provided a piece of flexible, resilient material 73. The material 73 is cut into eight triangular sections, A, B, C, D, E, F, G and H. Each of the sections A–H is designed to embrace the handle 75 of the rake 76 and is free to move as the handle of the rake 75 is moved.

Figure 3:
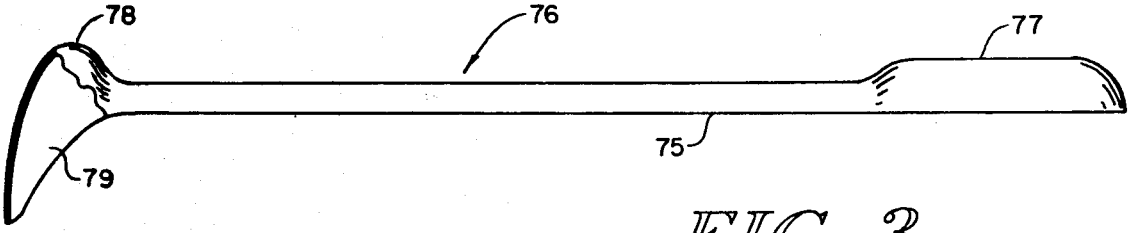
FIG. 3 is a partially cut-away side elevation view of a rake according to the present invention.
Figure 4:
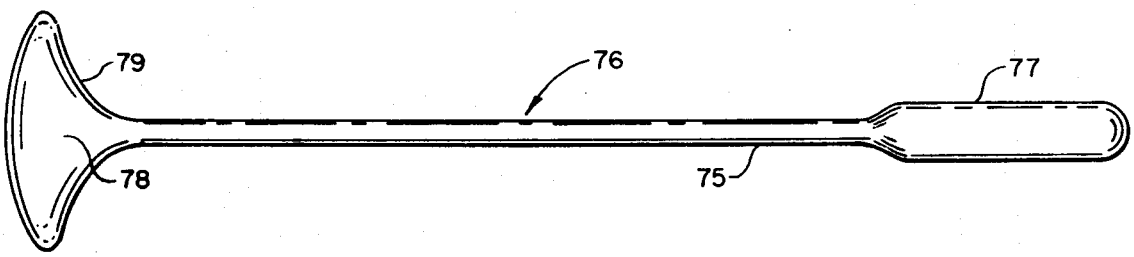
FIG. 4 is a top plan view of FIG. 3.

Referring to FIGS. 3 and 4, there is provided in the rake 75 at the end of the handle portion 76 an enlarged termination 77 and a rake head member 78 forming a shallow scooping cavity 79.

Figure 5:
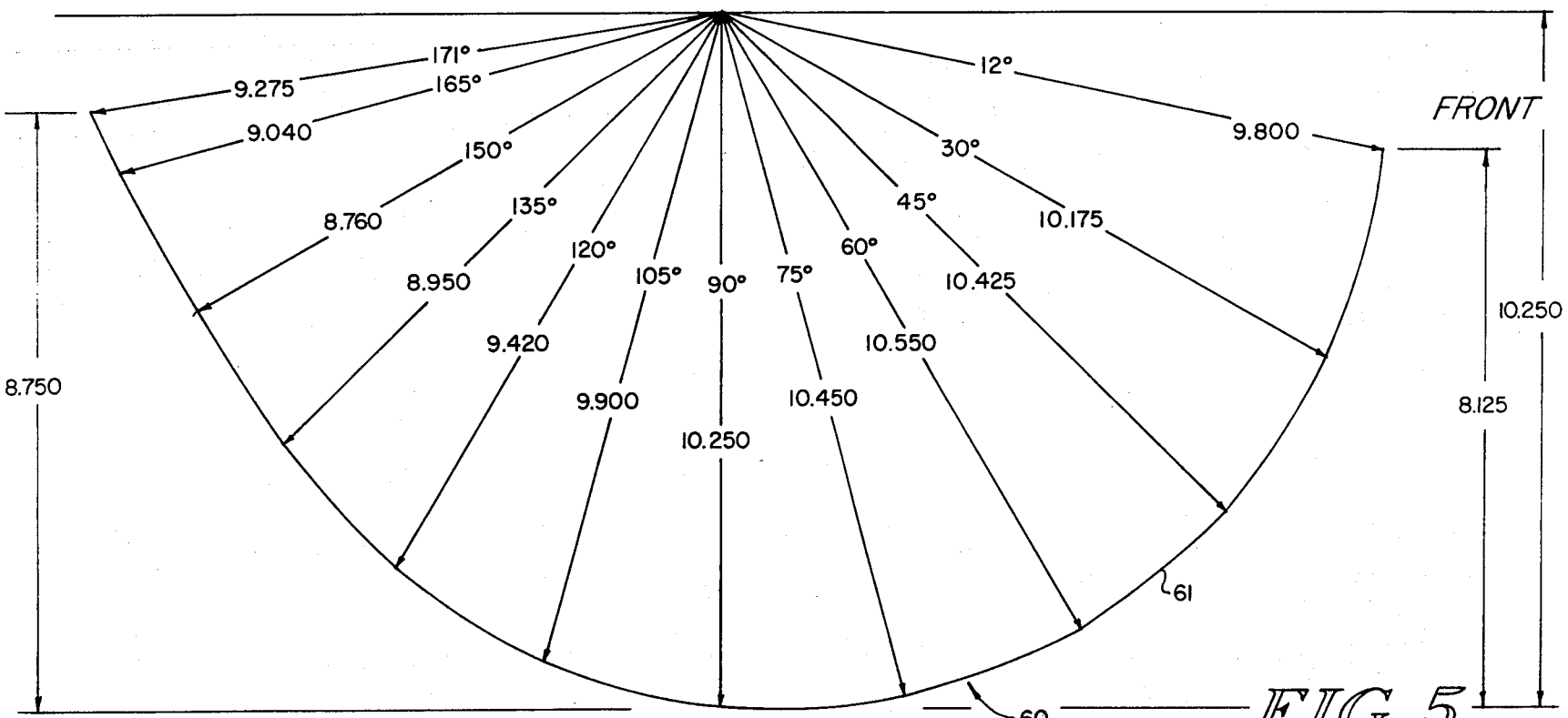
FIG. 5 is a diagram of typical dimensions of the curved bottom of the hopper of FIG. 2.

Referring to FIG. 5, there is provided a plurality of typical dimensions for the bottom member 60 described above with respect to FIG. 2. As shown in the FIG. 5, the front portion of the curved bottom member 60 subtends an angle between 12 degrees and 90 degrees relative to an overlying plane. The rear portion of the bottom member subtends an angle between approximately 90 degrees and 171 degrees relative to the overlying plane. The radius of the curved bottom at about 12 degrees relative to the plane is about 9.8 inches. The radius at about 30 degrees relative to the plane is about 10.175 inches. The radius at about 45 degrees relative to the plane is about 10.425 inches. The radius at about 60 degrees relative to the plane is about 10.55 inches. The radius at about 75 degrees relative to the plane is about 10.45 inches. The radius at about 90 degrees relative to the plane is about 10.25 inches. The radius at about 105 degrees relative to the plane is about 9.9 inches. The radius at about 120 degrees relative to the plane is about 9.42 inches. The radius at about 135 degrees relative to the plane is about 8.95 inches. The radius at about 150 degrees relative to the plane is about 8.76 inches. The radius at about 165 degrees relative to the plane is about 9.04 inches and the radius at about 171 degrees relative to the plane is about 9.275 inches. The height of the front and rear top edges of the bottom are about 8.125 inches and 8.75 inches, respectively. From the foregoing, it is clear that in a preferred embodiment of the apparatus according to the present invention the continuously changing radius of curvature of the front portion 61 to the right of the 90 degree radial line is generally larger than the continuously changing radius of curvature of the rear portion 62 to the left of the 90 degree radial line.

In use, a person selecting a product from a particular one of the plurality of hoppers grasps the handle of the rake 75 and pulls it forwardly and outwardly from the hopper through the hole 72. As the rake is pulled, product is captured in the cavity 79 in the rake head 78 and moved upwardly in the direction of the arrows shown in FIG. 2 and over the lip 63. As the product passes over the lip 63, it falls downwardly against the flap member 68, causing the flap member 68 to swing open. As the flap member 68 swings open, the product falls from the discharge port 67 into a container such as one of the bags from the assembly 51 provided therefor. When the product has cleared the spout 69, the flap 68 automatically swings shut, closing the spout.

To fill the hopper, the operator of the apparatus removes the cover member 45 and pours fresh product onto the rear portion 62 of the bottom member 60. As the product is poured into the hopper, it moves downwardly along the surface of the rear portion 62 in the direction of the arrows shown in FIG. 2, causing the existing product to move upwardly along the front portion 61 of the bottom member 60 to a point where it falls backward and on top of the fresh product moving therebeneath, as shown by the arrows in FIG. 2 in the vicinity of the rake member 75.

While the apparatus may be made from a variety of materials, it is preferable that the material be a clear, transparent material, such as lucite or the like in order that the food product displayed therein may be viewed from all sides. When so constructed, the apparatus and the food products stored therein are particularly esthetically pleasing.

While a particular and preferred embodiment of the present invention is described, it is contemplated that various changes in materials and arrangement of the various parts may be made by those skilled in the art within the spirit and scope of the present invention. For example, instead of joining the adjacent modules as by removably pinning the side and center walls thereof together, by pins extending from the top edges of the walls on one module into holes provided therefor in corresponding walls of an adjacent module, the modules may be permanently cemented together.

Accordingly, it is intended that the scope of the invention be not determined solely by reference to the embodiment described but rather be determined by reference to the claims hereinafter provided and their equivalents.

What is claimed is:

1. A bulk dry food product storage, display and dispensing apparatus comprising:

means forming a hopper comprising a pair of side wall members and a curved bottom, the curved bottom comprising a front portion and a rear portion, the front and rear portions each comprising a continuously changing radius of curvature, the continuously changing radius of curvature of the front portion being different from the continuously changing radius of curvature of the rear portion whereby fresh product being added to the hopper from the rear thereof by being dumped on the rear portion of the curved bottom slides down the rear portion, moves existing product forwardly, and displaces existing product being supported on the front portion causing the displaced product to move upwardly and fall on top of the fresh product moving therebeneath; and means forming a spout extending from the front of the hopper through which product is moved for removing product from the hopper.

2. An apparatus according to claim 1 comprising:

a movable flap member for opening and closing the spout.

3. An apparatus according to claim 2 comprising:

means forming a rake with an elongated handle portion for raking product from the apparatus through the spout.

4. An apparatus according to claim 3 wherein the spout comprises a tubular member having an interior opening through which product is moved from the hopper into the spout, the tubular member comprising:

an exterior wall in which there is provided, opposite the interior opening, a rake handle receiving hole for slidably receiving the handle of the rake; and means for closely embracing the rake handle which moves with the rake handle as the rake handle is moved for keeping dust and other foreign matter from passing through the rake receiving hole into the hopper.

5. An apparatus according to claim 4 wherein the hopper is made of a transparent material for providing a visual display of a product stored therein from all sides.

6. An apparatus according to claim 1 wherein the continuously changing radius of curvature of the front portion of the curved bottom is generally larger than the continuously changing radius of curvature of the rear portion.

7. An apparatus according to claim 6 wherein the front portion of the curved bottom subtends an angle between 12 degrees and 90 degrees relative to an overlying plane, the rear portion of the curved bottom subtends an angle between approximately 90 degrees and 171 degrees relative to the overlying plane, the radius of the curved bottom at about 12 degrees relative to the plane is about 9.800 inches, the radius at about 30 degrees relative to the plane is about 10.175 inches, the radius at about 45 degrees relative to the plane is about 10.425 inches, the radius at about 60 degrees relative to the plane is about 10.550 inches, the radius at about 75 degrees relative to the plane is about 10.450 inches, the radius at about 90 degrees relative to the plane is about 10.250 inches, the radius at about 105 degrees relative to the plane is about 9.900 inches, the radius at about 120 degrees relative to the plane is about 9.420 inches, the radius at about 135 degrees relative to the plane is about 8.950 inches, the radius at about 150 degrees relative to the plane is about 8.760 inches, the radius at about 165 degrees relative to the plane is about 9.040 inches, and the radius at about 171 degrees relative to the plane is about 9.275 inches.

8. An apparatus according to claim 1 comprising a base member and means for supporting a plurality of the hoppers side by side and one on top of another on the base member for storing different types of bulk dry food products.

9. An apparatus according to claim 1 wherein a predetermined number of hoppers are arranged in a side-by-side relationship with common sidewalls being used between adjacent hoppers for forming a module of hoppers to store different food products; and comprising: a base member and means for stacking a plurality of the modules vertically on the base member.

10. An apparatus according to claim 9 wherein the stacking means comprises means for pinning one module to another.

11. An apparatus according to claim 10 wherein the modules comprise a transparent material for displaying the products stored therein from all sides.

12. An apparatus according to claim 11 wherein a space is provided between the top of the base member and the bottom of the lowest of the modules for the storage of pre-packaged products therein.

13. A bulk dry food product storage, display and dispensing apparatus comprising:

a base member;

a plurality of modules, each of the modules comprising a plurality of hoppers having a curved bottom with the curved bottom of each of the hoppers comprising a front portion and a rear portion, the front and the rear portions each having a continuously changing radius of curvature with the continuously changing radius of curvature of the front portion being generally greater than the continuously changing radius of curvature of the rear portion, whereby fresh product being added to the hopper from the rear thereof by being dumped on the rear portion of the curved bottom displaces existing product on the front portion causing the displaced product to move on top of the fresh product moving therebeneath, and means forming a spout extending from the front portion for removing product from the hopper; and means for stacking in vertical relationship, a plurality of the modules on the base member.

14. An apparatus according to claim 13 wherein the modules are made of a transparent material for providing a visual display of a product stored therein from all sides.

15. An apparatus according to claim 13 comprising means forming a rake for raking product from each hopper through the spout.

16. A bulk dry food product storage, display and dispensing apparatus comprising:

a covered hopper having, extending from the front thereof, a spout; and a rake having an elongated handle extending through a hole provided therefor in a forward wall of said spout for raking product from the hopper through the spout.

17. An apparatus according to claim 16 wherein the spout comprises a tubular member which extends downwardly from the hopper and which has an exterior opening which is located at the lower end thereof.

18. An apparatus according to claim 17 comprising a movable flap member located in the spout for opening and closing the spout.

19. An apparatus according to claim 12 comprising a movable cover member which is located at the rear of the hopper for adding fresh product to the hopper.

* * * * *